United States Patent [19]

Pascoe, Sr. et al.

[11] 4,095,444

[45] Jun. 20, 1978

[54] APPARATUS FOR THE APPLICATION OF LIQUIDS TO MOVING MATERIALS

[75] Inventors: William Martin Pascoe, Sr.; David Bruce Wilson, both of Spartanburg, S.C.

[73] Assignee: Milliken Research Corporation, Spartanburg, S.C.

[21] Appl. No.: 806,783

[22] Filed: Jun. 15, 1977

[51] Int. Cl.[2] ..... D06B 1/02

[52] U.S. Cl. ..... 68/205 R

[58] Field of Search ..... 68/205 R, 183; 239/120, 239/122; 118/314, 315

[56] References Cited

U.S. PATENT DOCUMENTS

| | | | |
|---|---|---|---|
| 3,937,045 | 2/1976 | Klein et al. | 68/205 R |
| 4,019,352 | 4/1977 | McCollough, Jr. et al. | 68/205 R |

*Primary Examiner*—Philip R. Coe

*Attorney, Agent, or Firm*—Glen M. Burdick; H. William Petry

[57] ABSTRACT

Apparatus for the application of liquids to moving material, such as patterned application of dyes to moving textile material, which employs dye applicator gun bars to direct a plurality of streams of dye onto the moving material, means for deflecting certain of the streams of dye in a predetermined sequence to impart a pattern to the material, collection means for receiving the deflected dye and air deflector means operably associated with an air foil means in the collection means at a position above the collector plates of the collection means and extending downwardly toward the collector plates into a portion of an expanded air zone created by the expansion of air emitted from the deflecting means, the air deflector means extending into the expanded air zone forming an acute angle with an imaginary plane passing the end portion of the upper most collection plate, the imaginary plane being that plane substantially parallel to the liquid discharge axes of the plurality of streams of dye.

5 Claims, 6 Drawing Figures

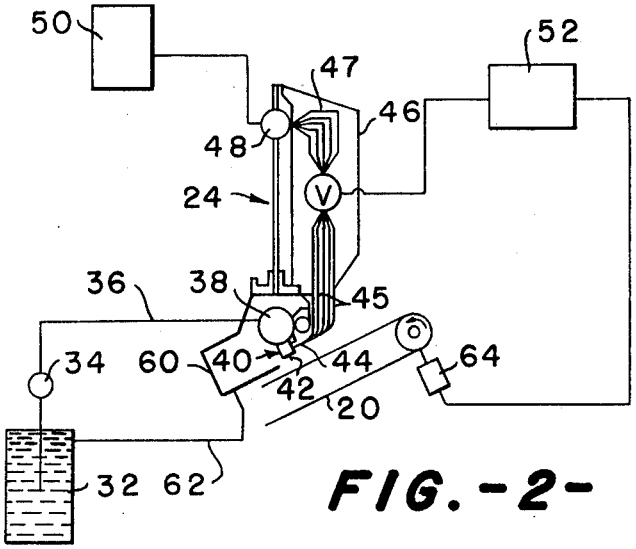
FIG.-2-
FIG.-5-
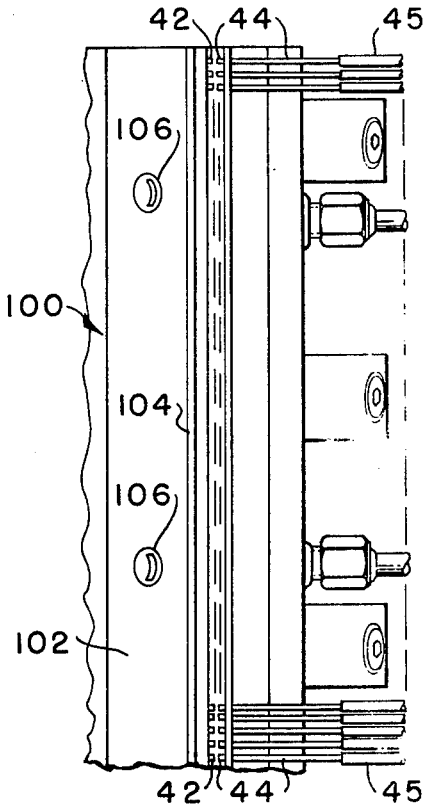
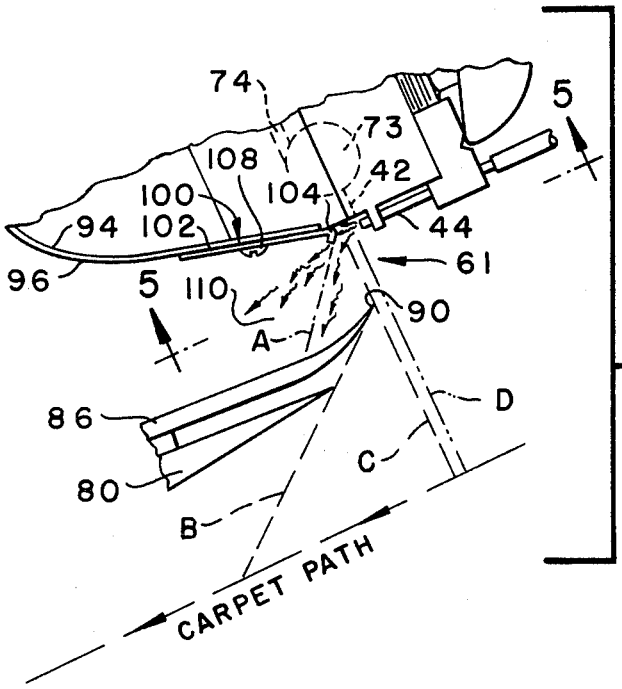
FIG.-4-
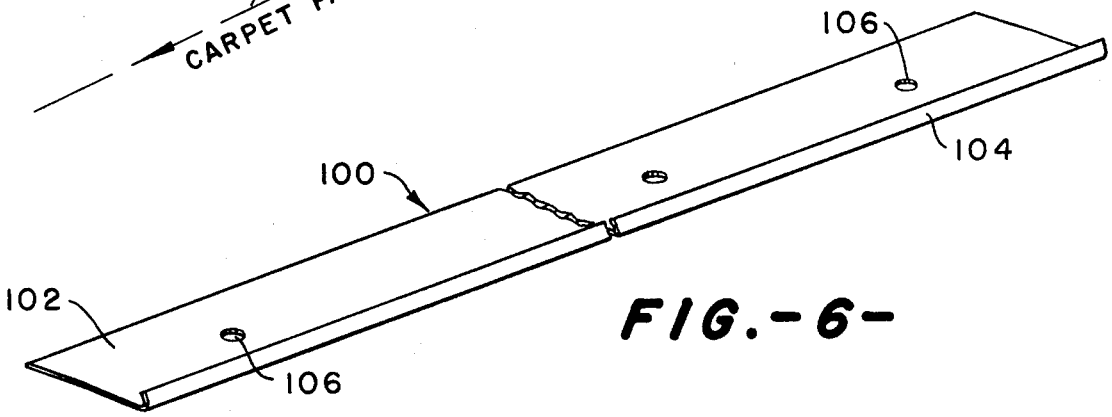
FIG.-6-

APPARATUS FOR THE APPLICATION OF LIQUIDS TO MOVING MATERIALS

The present invention is directed to apparatus for applying liquids to moving materials, and more particularly, to an improved apparatus for the patterned application of dye or other liquids to moving textile materials, such as pile carpets, fabrics and the like.

It is known to apply liquid dyes to moving textile materials from plural streams which are directed onto the materials and selectively controlled to produce a desired pattern thereon. McElveen U.S. Pat. No. 3,393,411 describes apparatus and process wherein plural streams of dye are selectively controlled in their flow to provide a distinct pattern on a pile carpet.

U.S. Pat. Nos. 3,443,878 and 3,570,275 describe apparatus and process for the patterned dyeing of a moving textile web wherein continuously flowing streams of dye normally directed in paths to impinge upon the web are selectively defined from contact with the web in accordance with pattern information. The webs are thus dyed in a desired pattern and the deflected dye is collected and recirculated for use.

In such continuous flow, deflection-type dyeing apparatus, it is known to position a plurality of dye applicators, or "dye gun bars", generally above the path of movement of a material to be dyed and wherein each of the gun bars extends across the path of material movement and is provided with a row of dye outlets which project streams of dye downwardly toward the material to be dyed. Each continuously flowing dye stream is selectively deflected by a stream of air which is discharged, in accordance with pattern information, from an air outlet located adjacent each dye discharge outlet. The air outlet is positioned to direct the air stream into intersecting relation with the dye stream and to deflect the dye into a collection chamber or trough for recirculation. To accurately control the amount of dye applied to a given location on the material during the dyeing operation, and to insure that the dye strikes the material in a very small, precise spot, the lower portion of the collection chamber contains a collector plate supportably positioned in spaced relation above the lower wall of the collection chamber. This collector plate is adjustably attached to the lower wall so that its edge can be accurately positioned relative to the dye discharge axes of the gun bar to insure prompt and precise interception of the streams when deflected. Details of such a dyeing apparatus and collection chamber construction are described and claimed in commonly assigned Klein U.S. Pat. No. 3,942,343 issued Mar. 9, 1976.

As described in U.S. Pat. No. 3,942,343, each dye stream, when deflected, passes across the edge of the collector plate and into the collection chamber. Upon removal of deflection from the stream, the stream moves back across the plate edge and resumes its normal path of travel toward the material to be dyed.

It was thereafter discovered that, during the movement of the stream across the edge of the collector plate, there was a tendency for the portion of the stream moving toward the material to be dyed to attach briefly to the plate, thus forming "trailing portions" of dye from the main body of the stream moving toward the material. These attached trailing portions of dye move downwardly along the under surface of the collector plate for a short distance from the edge before detachment. The distance the trailing edges of the dye streams travel along the under surface of the plate depended upon various factors of the system, e.g. angle and curvature of the collector plate, dye viscosity, surface tension, dye stream pressure, etc. When the trailing edges of the dye streams separate from the lower surface of the collector plate, it was found that a very fine mist of dye was produced in the area beneath the collector plate and above the surface of the material to be dyed. It was observed that a collection of dye forms on the under surface of the lower wall of the collection chamber produced occasional drops which fall from the collection chamber onto the materials being dyed. These droplets would, of course, adversely effect the pattern formed on the material.

Improvements were thus made in such dyeing apparatus which minimized and/or eliminated the adverse effects on the textile substrate of the dye mist and droplets formed during the pattern dyeing operation. Details of such improvements in the dyeing apparatus are described and claimed in commonly assigned McCollough et al., U.S. Pat. No. 4,019,352, issued Apr. 26, 1977.

It has now been discovered that while the adverse effects on the textile substrate of the dye mist and droplets formed during the pattern dyeing operation can be minimized and/or eliminated by the before-mentioned improvements in the dyeing apparatus, problems have never-the-less been encountered when employing closely spaced and/or small dye emitting orifices, in that the intermittent deflection of the dyestream into the collection chamber by the intermittent operation of the air deflecting stream has resulted in the tendency for a build-up of dye mist or droplets on the face portion of the dye gun bars containing the row of dye outlets which project the streams of dye downwardly toward the material being dyed. It has been observed that the collection of the dye on the face portion of the gun bar alters the direction of flow of the dye from the dye discharge orifice, thus adversely effecting the pattern formed on the material.

The present invention is thus directed to an improvement in dyeing apparatus of the type described which minimizes and/or eliminates the adverse effects of the dye mist and droplets formed on the face portion of the dye gun bars during the pattern dyeing operation, especially when employing closely spaced dyestreams.

The invention will be better understood and further explained by reference to the accompanying drawing, in which:

FIG. 2 is a schematic drawing of a single dye applicator, or gun bar, of the apparatus of FIG. 1 and shows a basic arrangement for supplying dye to and from, and air under pressure to each of the gun bars, together with control means for programming same;

FIG. 4 is an enlarged schematic side view of the lower portion of the dye applicator, the entrance opening of the collection chamber, and the air deflector means of FIG. 3;

FIG. 5 is an enlarged view of a portion of the dye jet applicator section of the gun bar, looking in the direction of arrows 5—5 of FIG. 4, and showing the air deflection means of the present invention and its relationship to the dye discharge outlets and their associated air supply conduits for deflecting the dye streams; and FIG. 6 is a perspective view illustrating the air deflector means of the present invention.

Figure 1:
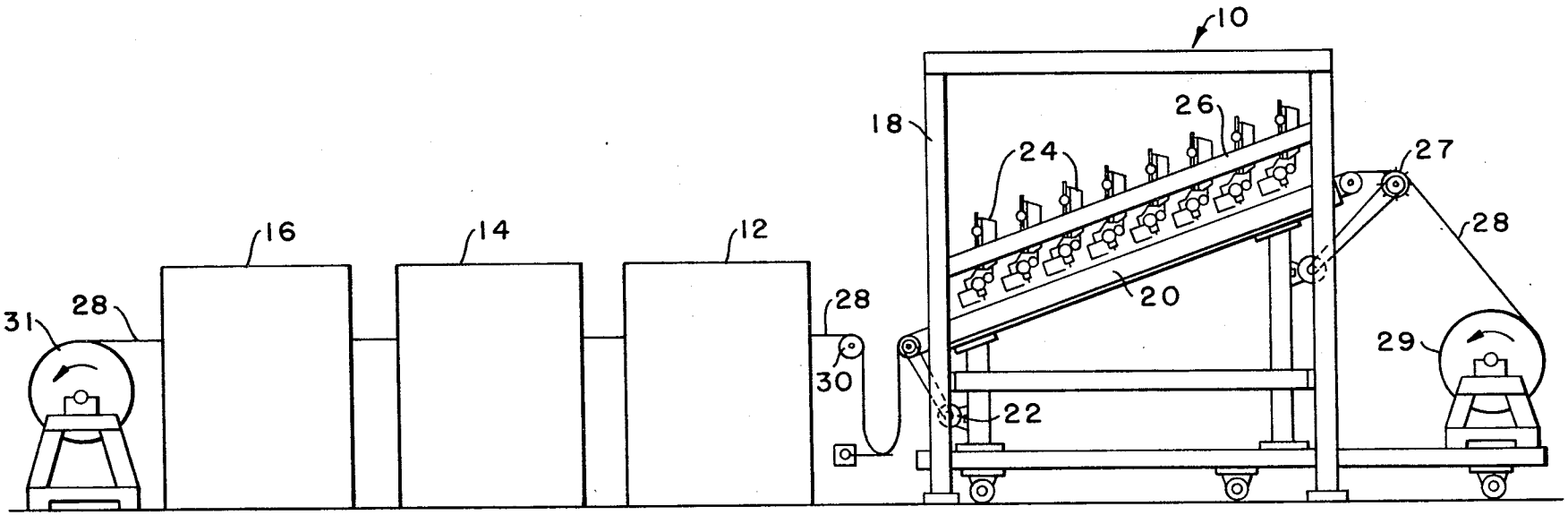
FIG. 1 is a schematic side elevation of apparatus for dyeing a moving material.

Referring more specifically to the drawings, FIG. 1 shows, in schematic side elevation, apparatus for applying liquids to a moving material to which the present invention pertains. As shown and as will be described, the apparatus is particularly adapted for the patterned application of dyes to a moving length of textile material such as fabric or pile carpet; however, it is to be understood that the liquid applicator of the apparatus could be employed to apply various types of liquids to various moving materials in a programmed manner.

The dyeing apparatus shown generally comprises a dye applicator section 10, a steam chamber 12, a washer 14, and a dryer 16. The dye applicator section 10 is composed of a main frame 18 supporting an inclined conveyor 20 which is driven by motor means 22. Positioned above and spaced along the length of the conveyor are plurality of dye applicator members, or gun bars 24, (8 being shown), which extend in parallel spaced relation across the width of the conveyor and are suitably supported at their ends by attachment to diagonal frame members (one of which, 26, is shown) on either side of the conveyor. For pattern dyeing broadloom carpets, the conveyor conveniently may be 12 to 15 feet in width and the gun bars 24 each are provided with a different color dye to apply a colored pattern to the carpet. Further, when pattern dyeing broadloom carpets the gun bars 24 each contain about 120 dye emitting orifices per foot, each orifice having a diameter of about 0.020 inches. However, when pattern dyeing a fabric it may be desired that more definition of the pattern be achieved. In such instances, the conveyor may be about 5 to 6 feet in width and the gun bars 24 are again each provided with a different color dye to apply a colored pattern to the fabric. In such instances each gun bar 24 is preferably provided with about 16 dye emitting orifices per inch, each orifice having a diameter of about 0.008 to 0.009 inches.

In operation, a length of textile material 28 such as a carpet is continuously withdrawn from a supply roll 29 by a driven pinroller 27 and delivered to the inclined conveyor 20 which transports the textile material beneath the gun bars 24. Each gun bar is provided with a different colored liquid dye which is dispensed in streams from orifices or outlets spaced along the gun bar onto the textile material as it passes through the applicator section 10. Details of the construction and control of gun bars will be explained hereinafter. Dyed textile material leaving conveyor 20 is directed by suitable support means, such as guide rollers, one of which 30 is shown, through the steam chamber 12, the washer 14, and the dryer 16 where the dyed textile material is treated in conventional manner to fix the dye, remove excess dye, and dry the dyed textile material, respectively. Details of the dye-fixing steam chamber 12, washer 14, and dryer 16 do not form part of the present invention and apparatus for performing such conventional practices are well known in the art. The dyed textile material is collected on a collection roll 31.

The gun bars 24 are of substantially identical construction and the details of their construction and operation can better be described by reference to FIGS. 2 and 3. As seen in FIG. 2, which is a schematic side elevation of a gun bar 24, each gun bar is provided with a separate dye reservoir tank 32 which supplies liquid dye, by means of pump 34 and conduit means 36, under pressure to a dye manifold pipe 38 of the gun bar. Pipe 38 communicates at suitable locations along its length with a sub-manifold section 40 attched to the pipe. The manifold pipe 38 and sub-manifold section 40 extend across the width of the conveyor 20 and sub-manifold section 40 is provided with a plurality of dye discharge outlets 42 spaced along its length to continuously discharge a row of parallel dye streams downwardly toward the material to be dyed.

Positioned adjacent and at about a right angle to each dye discharge outlet 42 of sub-manifold section 40 is an outlet of an air supply tube 44. Each air tube communicates by way of a conduit or tube 45 with a separate valve, illustrated collectively by the symbol V, located in a valve support box 46 of the gun bar. Each valve is, in turn, connected by a conduit or tube 47 to an air supply manifold 48 which is provided with pressurized air by a compressor 50. Each of the valves V, which may be of the electromagnetic solenoid type, are individually controlled by electrical signals from a pattern control device 52. The air outlets of tubes 44 provide streams of air to impinge at approximately right angles against the continuously flowing dye streams from the dye discharge outlets 42 and deflect the same into a collection chamber or trough 60 from which liquid dye is removed, by way of suitable conduit means 62, to dye reservoir tank 32 for recirculation.

The pattern control device 52 for operating the solenoid valves may be composed of various type pattern control means, such as a computer with magnetic tape transport for pattern information storage. Desired pattern information from control device 52 is transmitted to the solenoid valves of each gun bar at appropriate times in response to conveyor movement which is transmitted by suitable transducer means 64 operatively connecting the conveyor 20 and pattern control device 52.

In a typical dyeing operation utilizing the presently disclosed apparatus, when no pattern information is supplied to the air valves of the gun bars from pattern control device 52, the valves remain "open" to permit passage of pressurized air through air supply tubes 44 to continuously deflect all of the continuously flowing dye streams from the dye discharge outlets 42 of gun bar 24 into the collection chamber 60 for recirculation. When textile material to be dyed passes beneath the first gun bar of dye applicator section 10, pattern control device 52 is actuated in suitable manner, such as manually by an operator. Thereafter, signals from transducer 64 release pattern information from pattern control device 52 to selectively "close" the air valves so that the corresponding dye streams are not deflected, but pass in their normal discharge paths to strike the textile material. Thus, by operating the solenoid air valves of each gun bar in the desired pattern sequence, a colored pattern of dye is placed on the textile material during its passage through the dye applicator section 10.

Figure 3:
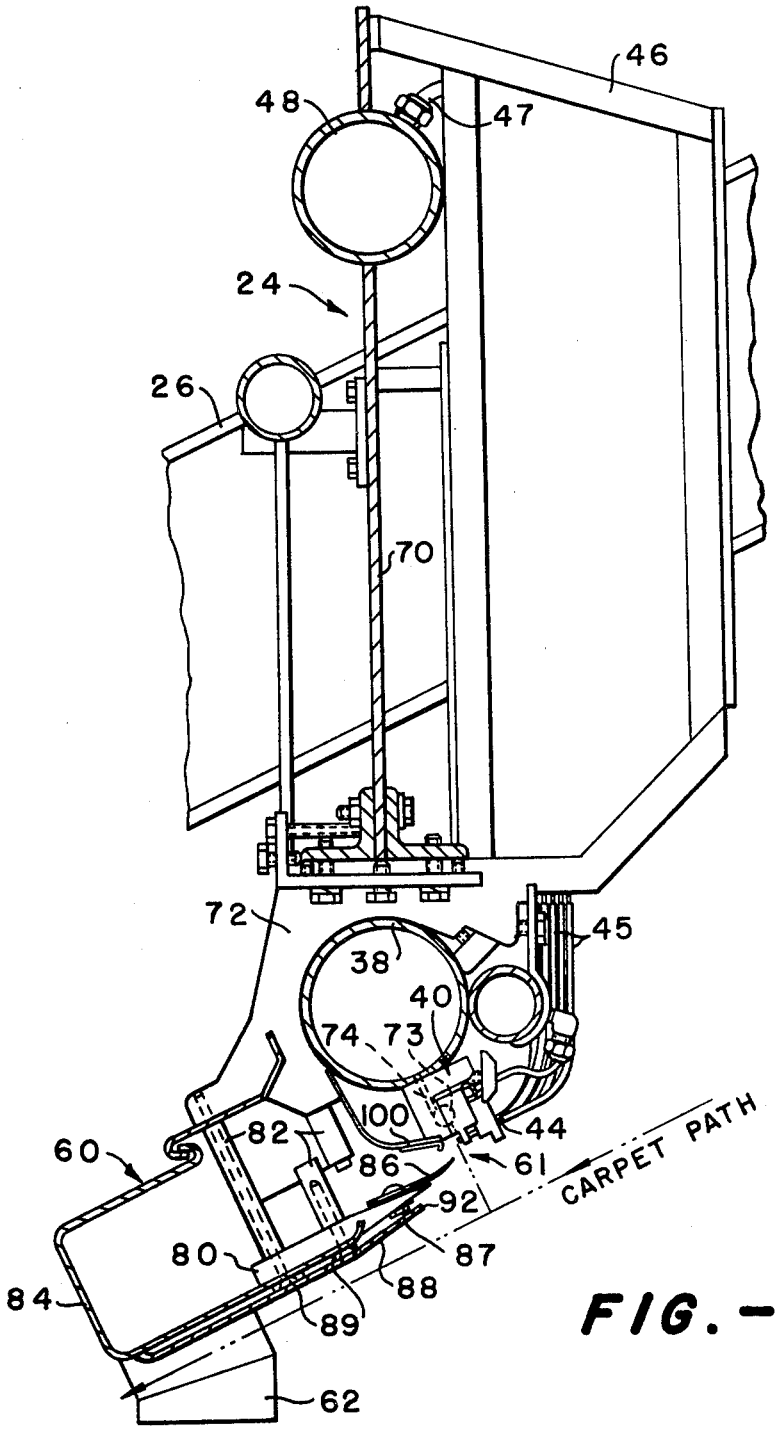
FIG. 3 is an enlarged schematic side view of the dye applicator and entrance opening of the collector chamber of the gun bar depicting the air deflector means of the present invention.

Referring now specifically to FIG. 3, each gun bar 24 includes a main structural support plate 70 which extends across the full width of the conveyor and is supportably attached to the diagonal members of the support frame. Attached to the upper portion of plate 70 is the air supply manifold 48 and adjustably attached to the lower flanged edge of the plate, by suitable bracket and clamp means 72, which are spaced along the length of plate 70, is the dye manifold pipe 38. Sub-manifold section 40 is suitably attached, as by bolts (not shown), to dye manifold pipe 38 and has a sub-manifold chamber 73 which communicates by way of a plurality of passageways 74 spaced along dye manifold pipe 38 with an interior chamber of dye manifold pipe 38 which receive dye therefrom. Sub-manifold chamber 73, the dye receiving chamber, of sub-manifold section 40 is provided with the plurality of dye discharge outlets 42 which are spaced along the length of sub-manifold section 40 and across the width of the conveyor to discharge dye in a row of parallel streams onto the moving carpet. Details of the dye manifold and sub-manifold construction form the subject U.S. Pat. No. 3,942,342, issued Mar. 9, 1976.

Details of the construction and arrangement of the dye collection trough or chamber which form the subject of commonly assigned McCollough et al., U.S. Pat. No. 4,019,352 and the air deflection means of the present invention may be best described by reference to FIGS. 3–6. The collection chamber 60 includes a relatively thick, rigid main support plate, or bar 80 which extends the entire length of the gun bar and is attached thereto at spaced locations along the length of the gun bar by rod members 82 connecting plate 80 to the clamping means 72. To provide positional stability for the collection chamber, the support plate 80 is formed of a high strength material, such as a relatively thick stainless steel plate.

The outer walls 84 of the collection chamber are conveniently formed of a thin, lightweight material, such as stainless steel sheet metal, attached in suitable manner to support plate 80 and clamping means 72 of the gun bar (FIG. 3). The outer edge portion of plate 80 is suitably tapered, as shown, to form a sharp edge which extends generally parallel to the row of dye outlets 42 of the gun bar. The support plate 80 also serves as a secondary dye collector, as will be explained.

Supportably positioned in spaced relation above the upper surface of the tapered portion of support plate 80 is a first, or primary dye collector plate 86 which extends the length of the gun bar and has a sharp outer edge positioned closely adjacent and parallel to the row of discharge outlets of the gun bar. Primary dye collector plate 86 is adjustably attached, as by bolt and spacer means 87, at spaced locations along its length to the upper surface of support plate 80 so that collector plate 86 may be moved to position its outer edge relative to the dye discharge axes of the dye discharge outlets. Various fastening means may be employed for adjustably mounting the primary collector plate and one such means is disclosed in previously referred to Klein U.S. Pat. No. 3,942,343.

Supportably attached, as by screw and spacer means 89, in spaced relation below the support plate 80 is a third dye collector plate 88, the outer edge of which extends generally parallel to the outer edges of support plate 80 and primary dye collector plate 86 and is located at a further distance from the discharge axes of the dye discharge outlets of the gun bar than these two edges. In the embodiment shown in FIG. 3, the third collector plate 88 does not communicate directly with the interior of the dye collection chamber, but extends in spaced relation below the collection chamber throughout its length to points beyond both sides of the conveyor so that dye collected by the third collector plate may drain from the open sides of the collector plate without striking the moving carpet being dyed.

As seen, the collection chamber 60 has an elongate opening or entrance 61 for the reception of deflected dye. The opening extends the length of the gun bar and is located on the opposite side of the discharge axes D of the dye discharge outlets 42 from air supply tubes 44. The dye deflected by streams of air from the air supply tubes passes into the opening of the dye collection chamber and flows by gravity into the lower interior portion of the chamber. The collected dye is removed, as by gravity, from the collection chamber through one or more drain lines 62 which direct the dye back to the dye reservoir 32 for recirculation.

The manner in which the dye collection chamber funcions during operation of the dyeing apparatus of the present invention will now be described. The outer edge 90 of the first or primary collector plate is positioned clearly adjacent the discharge axes D of the dye outlets to facilitate precise interception of the streams during deflection. The outer edge portion of the first collector plate is curved upwardly, as seen in side elevation, to facilitate gravitational flow of the intercepted dye downwardly into the interior portion of the collection chamber. As has been previously described, when a selected dye stream is deflected from its normal path of travel D onto the surface of the moving carpet, the pressurized air stream from its respective air tube deflects or displaces the stream across the edge 90 of the primary dye collector plate 86 and onto its upper surface. As the stream is deflected, it has been found that the last portion of the dye stream which is continuing in its path D to strike the carpet tends to attach momentarily to the under surface of primary dye collector plate 86. When deflection is removed from the stream and the stream moves back across the edge of the dye collector plate 86 to resume its normal path of discharge D, this same attachment effect has been observed. These attached portions of the dye stream move downwardly along the under surface of primary dye collector plate 86 and separate from the surface a short distance from the edge 90.

Upon separation, it has been observed that a portion of dye remains on the under surface of primary dye collector plate 86 to form droplets which will pass along the lower surface of primary dye collector plate 86 into the collection chamber or fall from the under surface onto the upper surface of main support plate 80. Thus, main support plate 80 serves as a secondary collector for dye to receive drops of dye falling from the primary dye collector plate 86 and pass these drops into the collection chamber.

It has also been observed that separation of the dye streams from the primary dye collector plate creates a fine mist of dye in an area, or zone, between the primary dye collector plate and the upper surface of the carpet being dyed. This dye mist is of sufficient fineness that, in dispersed state, it does not adversely effect the pattern of dye applied to the carpet; however, portions of the mist coalesce and attach to main support plate 80 and at times form a sufficient amount of dye on the under surface of plate 80 to cause drops of dye which fall by gravity from the surface of the plate. To intercept these drops and prevent their falling on the carpet, third collector plate 88 is positioned in spaced relation below main support plate 80. To prevent a similar collection of dye mist on the third collector plate, the edge 92 of plate 88 is positioned at a greater distance from the discharge axes of the dye streams than the edge of main support plate 80. Main support plate 80 thereby acts as a shield for the third collector plate by defining a boundary for the zone of mist created to prevent the mist from passing into the area of the third collector plate and attaching to its surface to form drops of dye. It has been found that this boundary may be approximated by a plane B tangent to the edge surfaces of main support plate 80 and primary dye collector plate 86, as illustrated in FIG. 3. Thus, the edge of third collector plate 88 may be located at a distance slightly further from the discharge axes of the dye discharge outlets than the plane B.

As previously described dye from sub-manifold section 40 is supplied continuously from dye discharge outlets 42 and the pattern in the fabric being dyed is controlled but cutting off or on the air pressure to selected air supply tubes 44 to divert the dye liquid into collection and separation chamber 60. Extending across the chamber 60 is an air foil means 94 which tends to direct dye in the air stream toward an opening in a cylinder in the rear portion (not shown) of the collection and separation chamber 60 for recirculation of the collected dye. Such a concept is disclosed and claimed in commonly assigned Klein et al. U.S. Pat. No. 3,937,045, issued Feb. 10, 1976. The dye in the air stream from the air supply tubes 44 is separated from the air stream by the Coanda effect of the air foil shape 96 of air foil means 94.

The intermittent deflection of the dyestream causes the formation of a dye mist, a portion of such mist being exterior collection and separation chamber 60. The air stream employed to divert the dye liquid into collection and separation chamber 60 is turbulent and diverges or expands upon exiting from air supply tubes 44. The expanded, turbulant air entrains surrounding air forming an air pump or aspirator. The resulting aspirated air flow appears to attract and entrain at least a portion of the dye mist exterior the collection and separation chamber thereby causing a build-up of dye on the face of the gun bar. Such a build-up of dye on the face of the gun bar has been observed when employing a gun bar having closely spaced and very small diameter dye discharge outlets. We have suprisingly found that such dye build up on the face of the gun bar can be substantially eliminated by the use of air deflector means 100.

Air deflector means 100, which extends the full length of each gun bar 24, is preferably a one-piece molded, cast or fabricated member which has an elongated body portion 102 and a lip portion 104. Air deflector means 100 is secured to the lower surface of air foil means 94 at a position above collector plate 86 so that lip portion 104 extends downwardly towards collector plate 86 closely adjacent the imaginary axis D of the dye discharge outlets 44 without interfering with the normal flow of the dye liquid from the dye discharge outlets. For instance, body portion 102 can be provided with a plurality of apertures 106 so that body member 102 can be securely affixed to air foil means 94 by bolts 108 as shown.

In order to achieve the desired result of preventing dye build-up on the face of the gun bar using the air deflection means of the present invention without adversely effecting the operation and efficiency of the dyeing appartus, lip portion 104 of air deflector means 100 is positioned so as to extend downwardly into a portion, not to exceed about 50 percent, of the diverged or expanded air zone 110 of the air emitted from air supply tubes 44 and lip portion 104 lies in plane A forming an acute angle with a plane C passing through the end portion of collector plate 86 near dye discharge axis D, the axis of plane C passing through the end portion of collector plate 86 being substantially parallel to the plane of discharge axis D. Further, lip portion 104 preferably does not contact the deflected dyestream diverted into collection and separation chamber 60 by the air discharged from air supply tubes 44. Preferably lip portion 104 forms an angle of about 40° with the axis of plane C passing through the end portion of the collector plate and thus with dye discharge axis D.

Having thus described the invention, we claim:

1. In an apparatus for applying liquids to moving material including means for conveying the material in a predetermined path of travel, liquid applicator means having a row of outlets positioned above the path of travel of the material for continuously discharging a corresponding row of generally parallel streams of liquid downwardly toward the path of travel of the material, air discharge means positioned on one side of said row of outlets so that discharge axes of said air discharge means intersect the discharge axes of the outlets for selectively deflecting the streams of liquid from said outlets away from the path of travel of the material, and a liquid collection chamber positioned on the other side of the discharge axes of the row of outlets from said deflecting means, said liquid collection chamber having an opening extending along the row of outlets for receiving the deflected liquid streams to prevent their contact with the moving material, an air foil means defining one surface of said collection chamber, said air foil means having a curbed surface extending from approximately tangent to the discharge axes of said gaseous fluid discharge orifices adjacent said opening and diverging progressively inwardly of said chamber from said opening and away from said axes of the gaseous fluid discharge orifices, a first liquid collector plate suportably positioned in said opening with an outer edge of the plate extending along the opening and positioned closely adjacent the liquid discharge axes of said outlets to intercept and direct deflected liquid into the collection chamber, and a second liquid collector plate positioned in spaced relation below said first collector plate and having an outer edge extending generally parallel to said first collector plate edge but positioned further from said discharge axes than said first collector plate edge for receiving liquid falling from the first plate and directing the liquid into the collection chamber, the improvement comprising air deflector means operably associated with said air foil means at a position above said first liquid collector plate and closely adjacent the liquid discharge axes of the outlets, said air deflector means extending downwardly toward said first collector plate into a portin of an expanded air zone created by the expansion of the air emitted from said air discharge means so that said air deflector means extending into said expanded air zone forms an acute angle with an imaginary plane passing through the end portion of said first collector plate closely adjacent said liquid discharge axes of said outlets, said imaginary plane being substantially parallel to said liquid discharge axes of said outlets.

2. The apparatus for applying liquids to moving material of claim 1 which further includes means for detachably securing said air deflector means to said air foil means.

3. The apparatus for applying liquids to moving material of claim 2 wherein said air deflector means is a unitary member comprising a body portion and a lip portion, said body portion having a plurality of aperatures therein for mating with aperatures in said air foil means for receiving fastening means for securing said air deflector means to said air foil, and said lip portion extending downwardly toward said first collector plate into up to about 50 percent of the cross-sectional area of said expanded air zone.

4. The apparatus for applying liquids to moving material of claim 3 which further includes a third liquid collector plate positioned in spaced relation below said second collector plate and having an outer edge extending generally parallel to said first and second collector plate edges but positioned further from said liquid discharge axes than said first and second collector plate edge to receive liquid falling from said second collector plate and prevent such liquid from contacting material moving on said path of travel of moving material.

5. The apparatus for applying liquids to moving material of claim 2 wherein said lip portion of said deflector means forms an angle of about 40° with the imaginary plane passing through the end portion of said first collector plate.

* * * * *

UNITED STATES PATENT OFFICE

CERTIFICATE OF CORRECTION

Patent No. 4,095,444 Dated June 20, 1978

Inventor(s) William Martin Pascoe, Sr. et al.

It is certified that error appears in the above-identified patent and that said Letters Patent are hereby corrected as shown below:

Column 3, line 33, delete "0.020" and insert therefor --.020--.

Column 6, line 11, delete "funcions" and insert therefor --functions--.

Column 6, line 14, delete "clearly" and insert therefor --closely--.

Column 8, line 34, delete "suportably" and insert therefor --supportably--.

Column 8, line 50, delete "portin" and insert therefor --portion--.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*